US009039357B2

(12) United States Patent
Lee

(10) Patent No.: US 9,039,357 B2
(45) Date of Patent: May 26, 2015

(54) SEAL ASSEMBLY INCLUDING GROOVES IN A RADIALLY OUTWARDLY FACING SIDE OF A PLATFORM IN A GAS TURBINE ENGINE

(71) Applicant: Ching-Pang Lee, Cincinnati, OH (US)

(72) Inventor: Ching-Pang Lee, Cincinnati, OH (US)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/043,958

(22) Filed: Oct. 2, 2013

(65) Prior Publication Data

US 2014/0205441 A1 Jul. 24, 2014

Related U.S. Application Data

(63) Continuation-in-part of application No. 13/747,868, filed on Jan. 23, 2013.

(51) Int. Cl.

*F04D 29/08* (2006.01)
*F01D 11/00* (2006.01)
*F01D 11/02* (2006.01)

(52) U.S. Cl.

CPC ..... *F01D 11/001* (2013.01); *F01D 11/02* (2013.01); *F05D 2250/37* (2013.01); *F05D 2240/80* (2013.01); *F05D 2250/71* (2013.01); *F05D 2260/14* (2013.01); *F05D 2250/38* (2013.01)

(58) Field of Classification Search

CPC ..... F01D 11/00; F01D 11/001; F01D 11/02; F01D 11/005; F01D 9/065
USPC ..... 415/115–116, 182.1, 183, 185, 191; 416/193 A
See application file for complete search history.

(56) References Cited

U.S. PATENT DOCUMENTS

| | | | | |
|---|---|---|---|---|
| 5,967,745 | A * | 10/1999 | Tomita et al. | 415/173.7 |
| 6,077,035 | A | 6/2000 | Walters et al. | |
| 6,152,690 | A | 11/2000 | Tomita et al. | |
| 6,887,039 | B2 | 5/2005 | Soechting et al. | |
| 7,114,339 | B2 * | 10/2006 | Alvanos et al. | 60/806 |
| 7,189,055 | B2 | 3/2007 | Marini et al. | |
| 7,244,104 | B2 * | 7/2007 | Girgis et al. | 416/193 A |
| 8,075,256 | B2 | 12/2011 | Little | |
| 2006/0269399 | A1 | 11/2006 | Girgis et al. | |
| 2010/0074734 | A1 | 3/2010 | Little | |
| 2011/0067414 | A1 | 3/2011 | Matwey et al. | |

FOREIGN PATENT DOCUMENTS

EP 1582697 A1 10/2005

* cited by examiner

*Primary Examiner* — Edward Look
*Assistant Examiner* — Christopher J Hargitt

(57) ABSTRACT

A seal assembly between a disc cavity and a turbine section hot gas path includes a stationary vane assembly and a rotating blade assembly downstream from the vane assembly and including a plurality of blades that are supported on a platform and rotate with a turbine rotor and the platform during operation of the engine. The platform includes a radially outwardly facing first surface, a radially inwardly facing second surface, a third surface, and a plurality of grooves extending into the third surface. The grooves are arranged such that a space is defined between adjacent grooves. During operation of the engine, the grooves guide purge air out of the disc cavity toward the hot gas path such that the purge air flows in a desired direction with reference to a direction of hot gas flow through the hot gas path.

20 Claims, 10 Drawing Sheets

SEAL ASSEMBLY INCLUDING GROOVES IN A RADIALLY OUTWARDLY FACING SIDE OF A PLATFORM IN A GAS TURBINE ENGINE

CROSS REFERENCE TO RELATED APPLICATIONS

This application is a Continuation-In-Part of U.S. patent application Ser. No. 13/747,868, filed Jan. 23, 2013, entitled "SEAL ASSEMBLY INCLUDING GROOVES IN AN INNER SHROUD IN A GAS TURBINE ENGINE" by Ching-Pang Lee, the entire disclosure of which is incorporated by reference herein.

FIELD OF THE INVENTION

The present invention relates generally to a seal assembly for use in a gas turbine engine that includes a plurality of grooves located on a radially outer side of a rotatable blade platform for assisting in limiting leakage between a hot gas path and a disc cavity.

BACKGROUND OF THE INVENTION

In multistage rotary machines such as gas turbine engines, a fluid, e.g., intake air, is compressed in a compressor section and mixed with a fuel in a combustion section. The mixture of air and fuel is ignited in the combustion section to create combustion gases that define a hot working gas that is directed to turbine stage(s) within a turbine section of the engine to produce rotational motion of turbine components. Both the turbine section and the compressor section have stationary or non-rotating components, such as vanes, for example, that cooperate with rotatable components, such as blades, for example, for compressing and expanding the hot working gas. Many components within the machines must be cooled by a cooling fluid to prevent the components from overheating.

Ingestion of hot working gas from a hot gas path to disc cavities in the machines that contain cooling fluid reduces engine performance and efficiency, e.g., by yielding higher disc and blade root temperatures. Ingestion of the working gas from the hot gas path to the disc cavities may also reduce service life and/or cause failure of the components in and around the disc cavities.

SUMMARY OF THE INVENTION

In accordance with a first aspect of the invention, a seal assembly is provided between a disc cavity and a hot gas path that extends through a turbine section of a gas turbine engine. The seal assembly comprises a stationary vane assembly including a plurality of vanes and an inner shroud, and a rotating blade assembly downstream from the vane assembly and including a plurality of blades that are supported on a platform and rotate with a turbine rotor and the platform during operation of the engine. The platform comprises a radially outwardly facing first surface, a radially inwardly facing second surface, a third surface facing an axial direction defined by a longitudinal axis of the turbine section, and a plurality of grooves extending into the third surface. The grooves are arranged such that a space having a component in a circumferential direction is defined between adjacent grooves, the circumferential direction corresponding to a direction of rotation of the blade assembly. During operation of the engine, the grooves guide purge air out of the disc cavity toward the hot gas path such that the purge air flows in a desired direction with reference to a direction of hot gas flow through the hot gas path.

In accordance with a second aspect of the invention, a seal assembly is provided between a disc cavity and a hot gas path that extends through a turbine section of a gas turbine engine. The seal assembly comprises a stationary vane assembly including a plurality of vanes and an inner shroud, and a rotating blade assembly downstream from the vane assembly and including a plurality of blades that are supported on a platform and rotate with a turbine rotor and the platform during operation of the engine. The platform comprises a radially outwardly facing first surface, a radially inwardly facing second surface, a third surface facing an axial direction defined by a longitudinal axis of the turbine section, and a plurality of grooves extending into the third surface. The third surface of the platform extends radially inwardly from the first surface of the platform at an angle relative to the longitudinal axis such that the third surface of the platform also faces in the radial direction. The grooves are arranged such that a space having a component in a circumferential direction is defined between adjacent grooves, the circumferential direction corresponding to a direction of rotation of the blade assembly. The grooves are tapered from entrances thereof located distal from the first surface of the platform to exits thereof located proximate to the first surface of the platform such that the entrances are wider than the exits. During operation of the engine, the grooves guide purge air out of the disc cavity toward the hot gas path such that a flow direction of the purge air is generally aligned with a direction of hot gas flow through the hot gas path, which is generally parallel to an exit angle of a trailing edge of at least one of the vanes.

In accordance with a third aspect of the invention, a seal assembly is provided between a disc cavity and a hot gas path that extends through a turbine section of a gas turbine engine including a turbine rotor. The seal assembly comprises a stationary vane assembly and a blade assembly rotatable with the turbine rotor and located downstream from the vane assembly. The vane assembly includes a plurality of vanes and an inner shroud. The inner shroud comprises a radially outwardly facing first surface, a radially inwardly and axially downstream facing second surface, the axial direction defined by a longitudinal axis of the turbine section, and a plurality of vane grooves extending into the second surface. The vane grooves are arranged such that a space having a component in a circumferential direction is defined between adjacent vane grooves, the circumferential direction corresponding to a direction of rotation of the turbine rotor. The blade assembly includes a plurality of blades supported on a platform. The platform comprises a radially outwardly facing first surface, a radially inwardly facing second surface, a radially outwardly and axially upstream facing third surface, and a plurality of blade grooves extending into the third surface of the platform. The blade grooves are arranged such that a space having a component in the circumferential direction is defined between adjacent blade grooves. During operation of the engine, the vane grooves and blade grooves each guide purge air out of the disc cavity toward the hot gas path such that the purge air flows in a desired direction with reference to a direction of hot gas flow through the hot gas path.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
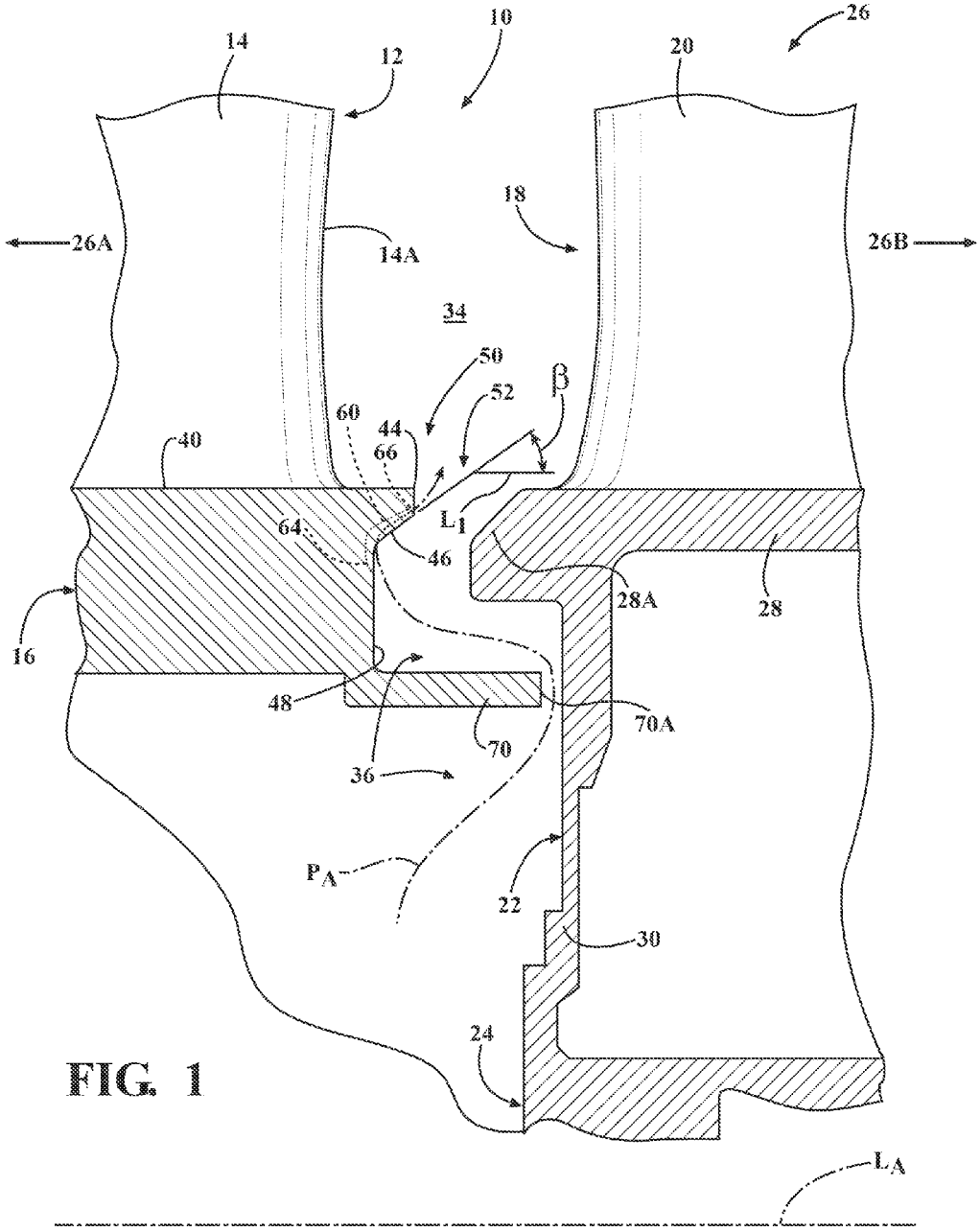
FIG. 1 is a diagrammatic sectional view of a portion of a turbine stage in a gas turbine engine including a seal assembly in accordance with an embodiment of the invention.

Referring to FIG. 1, a portion of a turbine engine 10 is illustrated diagrammatically including a stationary vane assembly 12 including a plurality of vanes 14 suspended from an outer casing (not shown) and affixed to an annular inner shroud 16, and a blade assembly 18 including a plurality of blades 20 and rotor disc structure 22 that forms a part of a turbine rotor 24. The vane assembly 12 and the blade assembly 18 may be collectively referred to herein as a "stage" of a turbine section 26 of the engine 10, which may include a plurality of stages as will be apparent to those having ordinary skill in the art. The vane assemblies 12 and blade assemblies 18 are spaced apart from one another in an axial direction defining a longitudinal axis $L_A$ of the engine 10, wherein the vane assembly 12 illustrated in FIG. 1 is upstream from the illustrated blade assembly 18 with respect to an inlet 26A and an outlet 26B of the turbine section 26, see FIGS. 1 and 3.

The rotor disc structure 22 may comprise a platform 28, a blade disc 30, and any other structure associated with the blade assembly 18 that rotates with the rotor 24 during operation of the engine 10, such as, for example, roots, side plates, shanks, etc.

The vanes 14 and the blades 20 extend into an annular hot gas path 34 defined within the turbine section 26. A working gas $H_G$ (see FIG. 3) comprising hot combustion gases is directed through the hot gas path 34 and flows past the vanes 14 and the blades 20 to remaining stages during operation of the engine 10. Passage of the working gas $H_G$ through the hot gas path 34 causes rotation of the blades 20 and the corresponding blade assembly 18 to provide rotation of the turbine rotor 24.

Referring to FIG. 1, a disc cavity 36 is located radially inwardly from the hot gas path 34 between the annular inner shroud 16 and the rotor disc structure 22. Purge air $P_A$, such as, for example, compressor discharge air, is provided into the disc cavity 36 to cool the inner shroud 16 and the rotor disc structure 22. The purge air $P_A$ also provides a pressure balance against the pressure of the working gas $H_G$ flowing through the hot gas path 34 to counteract a flow of the working gas $H_G$ into the disc cavity 36. The purge air $P_A$ may be provided to the disc cavity 36 from cooling passages (not shown) formed through the rotor 24 and/or from other upstream passages (not shown) as desired. It is noted that additional disc cavities (not shown) are typically provided between remaining inner shrouds 16 and corresponding adjacent rotor disc structures 22.

Figure 2:
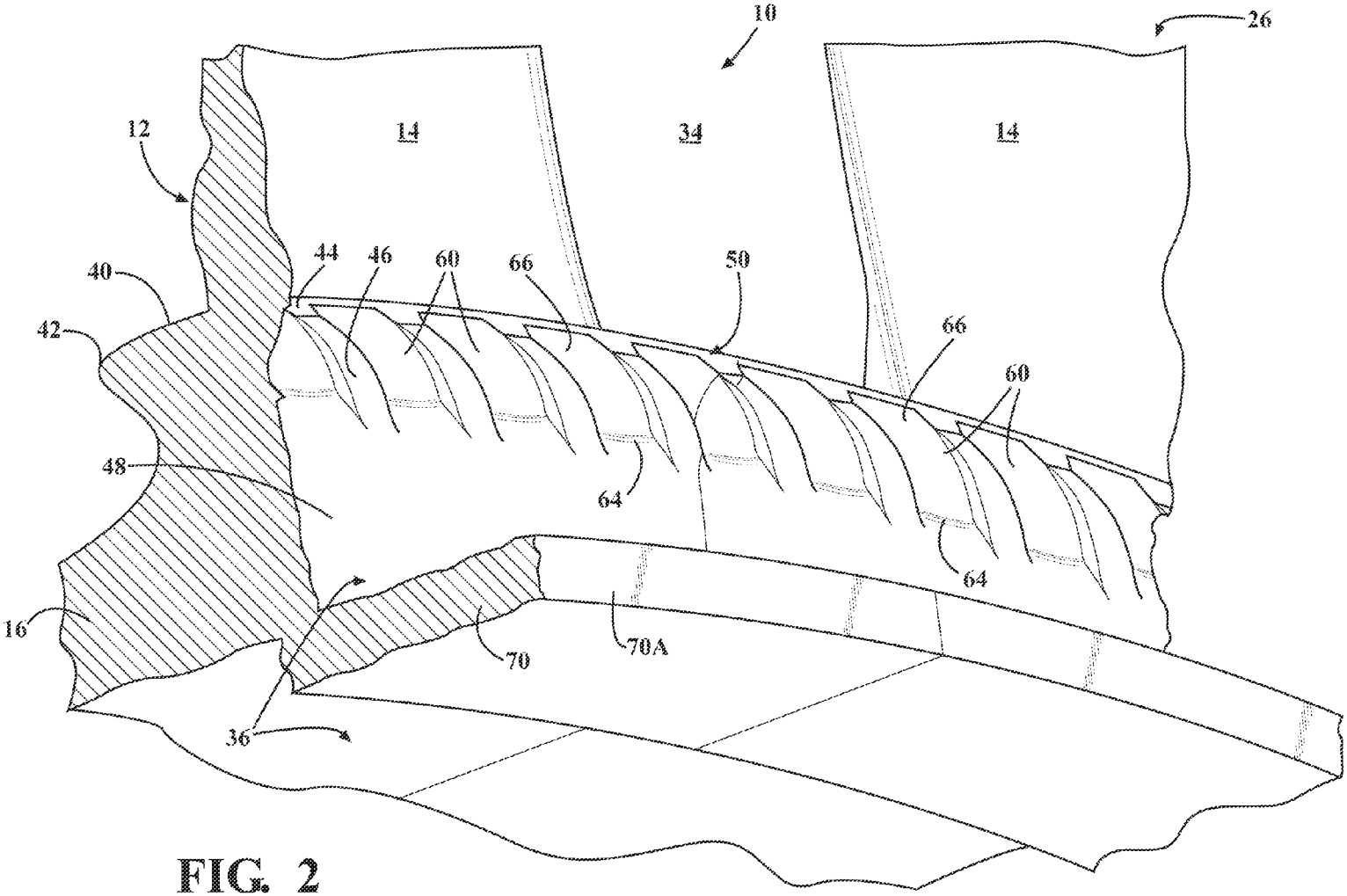
FIG. 2 is a fragmentary perspective view of a plurality of grooves of the seal assembly of FIG. 1.
Figure 3:
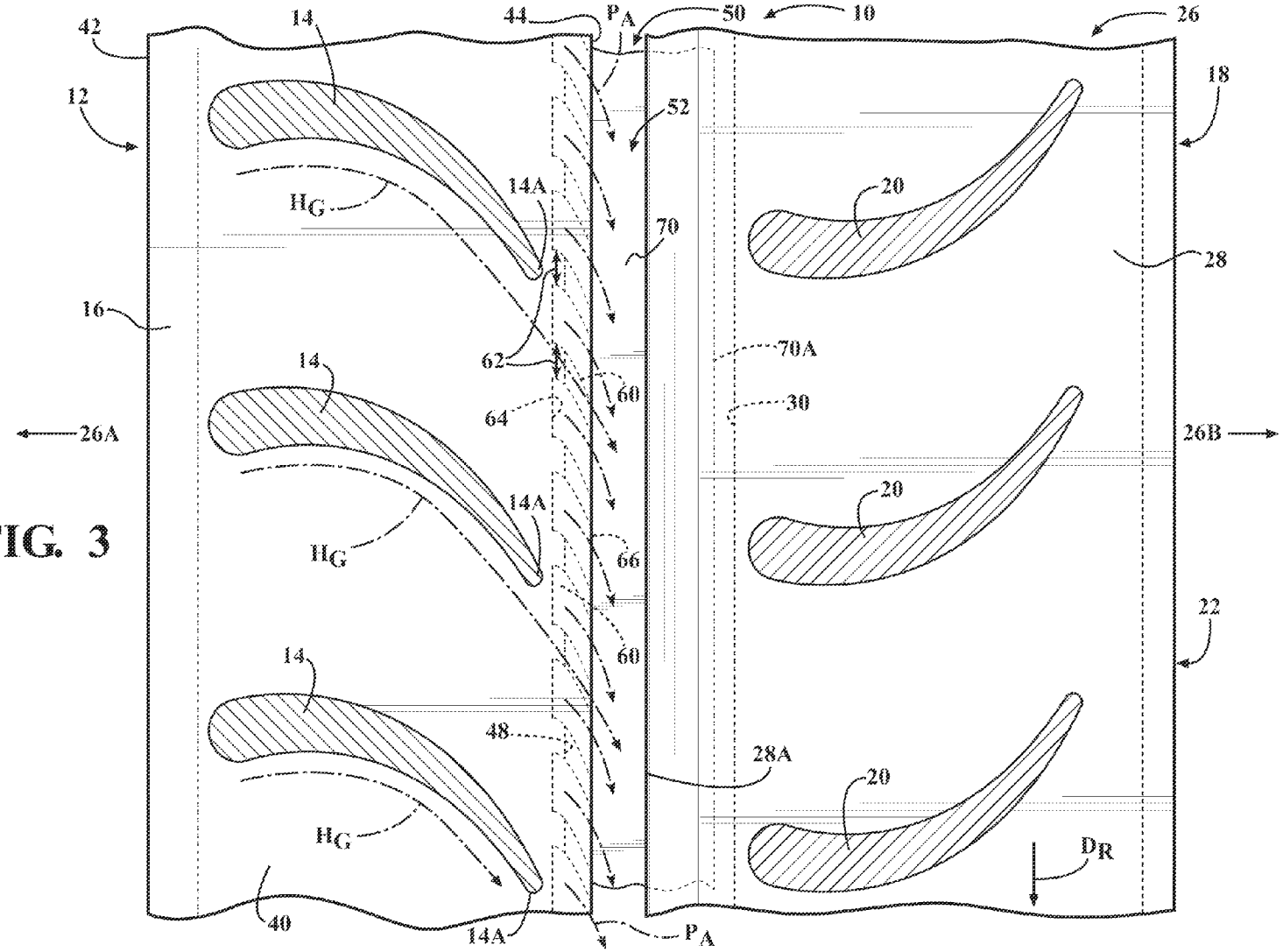
FIG. 3 is a cross sectional view of the stage illustrated in FIG. 1 looking in a radially inward direction.

As shown in FIGS. 1-3, the inner shroud 16 in the embodiment shown comprises a generally radially facing extending first surface 40 from which the vanes 14 extend. The first surface 40 in the embodiment shown extends from an axially upstream end portion 42 of the inner shroud 16 to an axially downstream end portion 44, see FIGS. 2 and 3. The inner shroud 16 further comprises a radially inwardly and axially downstream facing second surface 46 that extends from the axially downstream end portion 44 of the inner shroud 16 away from the adjacent blade assembly 18 to a generally axially facing third surface 48 of the inner shroud 16, see FIGS. 1 and 2. The second surface 46 of the inner shroud 16 in the embodiment shown extends from the downstream end portion 44 at an angle β relative to a line L1 that is parallel to the longitudinal axis $L_A$, i.e., such that the second surface 46 also extends from the downstream end portion 44 at the angle β relative to the longitudinal axis $L_A$, which angle β is preferably between about 30-60° and is about 45° in the embodiment shown, see FIG. 1. The third surface 48 extends radially inwardly from the second surface 46 and faces the rotor disc structure 22 of the adjacent blade assembly 18.

Components of the inner shroud 16 and the rotor disc structure 22 radially inwardly from the respective vanes 14 and blades 20 cooperate to form an annular seal assembly 50 between the hot gas path 34 and the disc cavity 36. The annular seal assembly 50 assists in preventing ingestion of the working gas $H_G$ from the hot gas path 34 into the disc cavity 36 and delivers a portion of the purge air $P_A$ out of the disc cavity 36 in a desired direction with reference to a flow direction of the working gas $H_G$ through the hot gas path 34 as will be described herein. It is noted that additional seal assemblies 50 similar to the one described herein may be provided between the inner shrouds 16 and the adjacent rotor disc structures 22 of the remaining stages in the engine 10, i.e., for assisting in preventing ingestion of the working gas $H_G$ from the hot gas path 34 into the respective disc cavities 36 and to deliver purge air $P_A$ out of the disc cavities 36 in a desired direction with reference to the flow direction of the working gas $H_G$ through the hot gas path 34 as will be described herein.

As shown in FIGS. 1-3, the seal assembly 50 comprises portions of the vane and blade assemblies 12, 18. Specifically, in the embodiment shown, the seal assembly 50 comprises the second and third surfaces 46, 48 of the inner shroud 16 and an axially upstream end portion 28A of the platform 28 of the rotor disc structure 22. These components cooperate to define an outlet 52 for the purge air $P_A$ out of the disc cavity 36, see FIGS. 1 and 3.

The seal assembly 50 further comprises a plurality of grooves 60, also referred to herein as vane grooves, extending into the second and third surfaces 46, 48 of the inner shroud 16. The grooves 60 are arranged such that spaces 62 having components in a circumferential direction are defined between adjacent grooves 60, see FIGS. 2 and 3. The size of the spaces 62 may vary depending on the particular configuration of the engine 10 and may be selected to fine tune discharging of purge air $P_A$ from the grooves 60, wherein the discharging of the purge air $P_A$ from the grooves 60 will be discussed in more detail below.

Figure 2A:
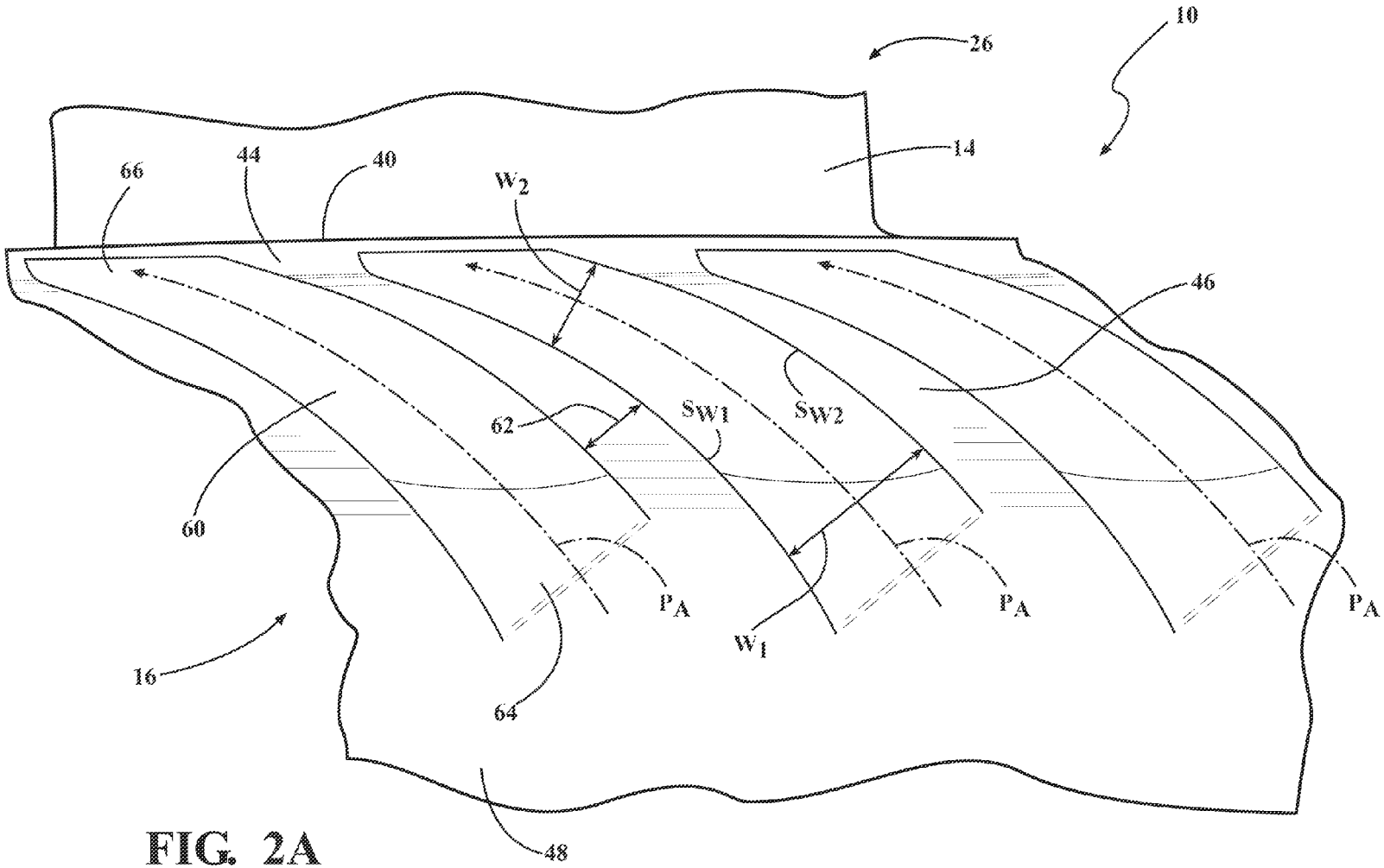
FIG. 2A is an elevational view of a number of the grooves illustrated in FIG. 2.

As shown most clearly in FIG. 2, entrances 64 of the grooves 60, i.e., where purge air $P_A$ from the disc cavity 36 to be discharged toward the hot gas path 34 enters the grooves 60, are located distal from the axial end portion 44 of the inner shroud 16 in the third surface 48 thereof, and outlets or exits 66 of the grooves 60, i.e., where the purge air $P_A$ is discharged from the grooves 60, are located proximate to the axial end portion 44 of the inner shroud 16 in the second surface 46 thereof. Referring to FIG. 2A, the grooves 60 are preferably tapered from the entrances 64 thereof to the exits 66 thereof such that widths $W_1$ of the entrances 64 are wider than widths $W_2$ of the exits 66, wherein the widths $W_1$, $W_2$ are respectively measured between opposing side walls $S_{W1}$, $S_{W2}$ of the inner shroud 16 that define the grooves 60 in directions substantially perpendicular to the general flow direction of the purge air $P_A$ through the respective grooves 60. The tapering of the grooves 60 in this manner is believed to provide a more concentrated and influential discharge of the purge air $P_A$ out of the grooves 60 so as to more effectively prevent ingestion of the working gas $H_G$ into the disc cavity 36 as will be described below.

As shown in FIG. 3, the grooves 60 are also preferably angled and/or curved in the circumferential direction such that the entrances 64 thereof are located upstream from the exits 66 thereof with reference to a direction of rotation $D_R$ of the turbine rotor 24. Angling and/or curving the grooves 60 in this manner effects a guidance of the purge air $P_A$ from the disc cavity 36 out of the grooves 60 toward the hot gas path 34 such that the purge air $P_A$ flows in a desired direction with reference to the flow of the working gas $H_G$ through the hot gas path 34. Specifically, the grooves 60 according to this aspect of the invention guide the purge air $P_A$ out of the disc cavity 36 such that a flow direction of the purge air $P_A$ is generally aligned with a flow direction of the working gas $H_G$ at a corresponding axial location of the hot gas path 34, which flow direction of the working gas $H_G$ at the corresponding axial location of the hot gas path 34 is generally parallel to exit angles of trailing edges 14A of the vanes 14.

Referring to FIGS. 1-3, the seal assembly 50 further comprises a generally axially extending seal structure 70 of the inner shroud 16 that extends from the third surface 48 thereof toward the blade disc 30 of the blade assembly 18. As shown in FIGS. 1 and 3, an axial end 70A of the seal structure 70 is in close proximity to the blade disc 30 of the blade assembly 18. The seal structure 70 may be formed as an integral part of the inner shroud 16, or may be formed separately from the inner shroud 16 and affixed thereto. As shown in FIG. 1, the seal structure 70 preferably overlaps the upstream end 28A of the platform 28 such that any ingestion from the hot gas path 34 into the disc cavity 36 must travel through a tortuous path.

During operation of the engine 10, passage of the hot working gas $H_G$ through the hot gas path 34 causes the blade assembly 18 and the turbine rotor 24 to rotate in the direction of rotation $D_R$ shown in FIG. 3.

A pressure differential between the disc cavity 36 and the hot gas path 34, i.e., the pressure in the disc cavity 36 is greater than the pressure in the hot gas path 34, causes purge air $P_A$ located in the disc cavity 36 to flow toward the hot gas path 34, see FIG. 1. As the purge air $P_A$ reaches the third surface 48 of the inner shroud 36, a portion of the purge air $P_A$ flows into the entrances 64 of the grooves 60. This portion of the purge air $P_A$ flows radially outwardly through the grooves 60 and then, upon reaching the portions of the grooves 60 within the second surface 46 of the inner shroud 16, the purge air $P_A$ flows radially outwardly and axially within the grooves 60 toward the adjacent blade assembly 18. Due to the angling and/or curving of the grooves 60 as discussed above, the purge air $P_A$ is provided with a circumferential velocity component such that the purge air $P_A$ is discharged out of the grooves 60 in generally the same direction as the working gas $H_G$ is flowing after exiting the trailing edges 14A of the vanes 14, see FIG. 3.

The discharge of the purge air $P_A$ from the grooves 60 assists in limiting ingestion of the hot working gas $H_G$ from the hot gas path 34 into the disc cavity 36 by forcing the working gas $H_G$ away from the seal assembly 50. Since the seal assembly 50 limits working gas $H_G$ ingestion from the hot gas path 34 into the disc cavity 36, the seal assembly 50 allows for a smaller amount of purge air $P_A$ to be provided to the disc cavity 36, thus increasing engine efficiency.

Moreover, since the purge air $P_A$ is discharged out of the grooves 60 in generally the same direction that the working gas $H_G$ flows through the hot gas path 34 after exiting the trailing edges 14A of the vanes 14, there is less pressure loss associated with the purge air $P_A$ mixing with the working gas $H_G$, thus additionally increasing engine efficiency. This is especially realized by the grooves 60 of the present invention since they are formed in the downstream end portion 44 of the inner shroud 16, such that the purge air $P_A$ discharged from the grooves 60 flows axially in the downstream flow direction of the hot working gas $H_G$ through the hot gas path 34, in addition to the purge air $P_A$ being discharged from the grooves 60 in generally the same circumferential direction as the flow of hot working gas $H_G$ after exiting the trailing edges 14A of the vanes 14, i.e., as a result of the grooves 60 being angled and/or curved in the circumferential direction. The grooves 60 formed in the inner shroud 16 are thus believed to provide less pressure loss associated with the purge air $P_A$ mixing with the working gas $H_G$ than if they were formed in the upstream end portion 28A of the platform 28, as purge air discharged out of grooves formed in the upstream end portion 28A of the platform 28 would flow axially upstream with regard to the flow direction of the hot working gas $H_G$ through the hot gas path 34, thus resulting in higher pressure losses associated with the mixing.

It is noted that the angle and/or curvature of the grooves 60 could be varied to fine tune the discharge direction of the purge air $P_A$ out of the grooves 60. This may be desirable based on the exit angles of trailing edges 14A of the vanes 14 and/or to vary the amount of pressure loss associated with the purge air $P_A$ mixing with the working gas $H_G$ flowing through the hot gas path 34.

Further, the entrances 64 of the grooves 60 could be located further radially inwardly or outwardly in the third surface 48 of the inner shroud 16, or the entrances 64 could be located in the second surface 46 of the inner shroud 16, i.e., such that the entireties of the grooves 60 would be located in the second surface 46 of the inner shroud 16.

Finally, the grooves 60 described herein are preferably cast with the inner shroud 16 or machined into the inner shroud 16. Hence, a structural integrity and a complexity of manufacture of the grooves 60 are believed to be improved over ribs that are formed separately from and affixed to the inner shroud 16.

Figure 4:
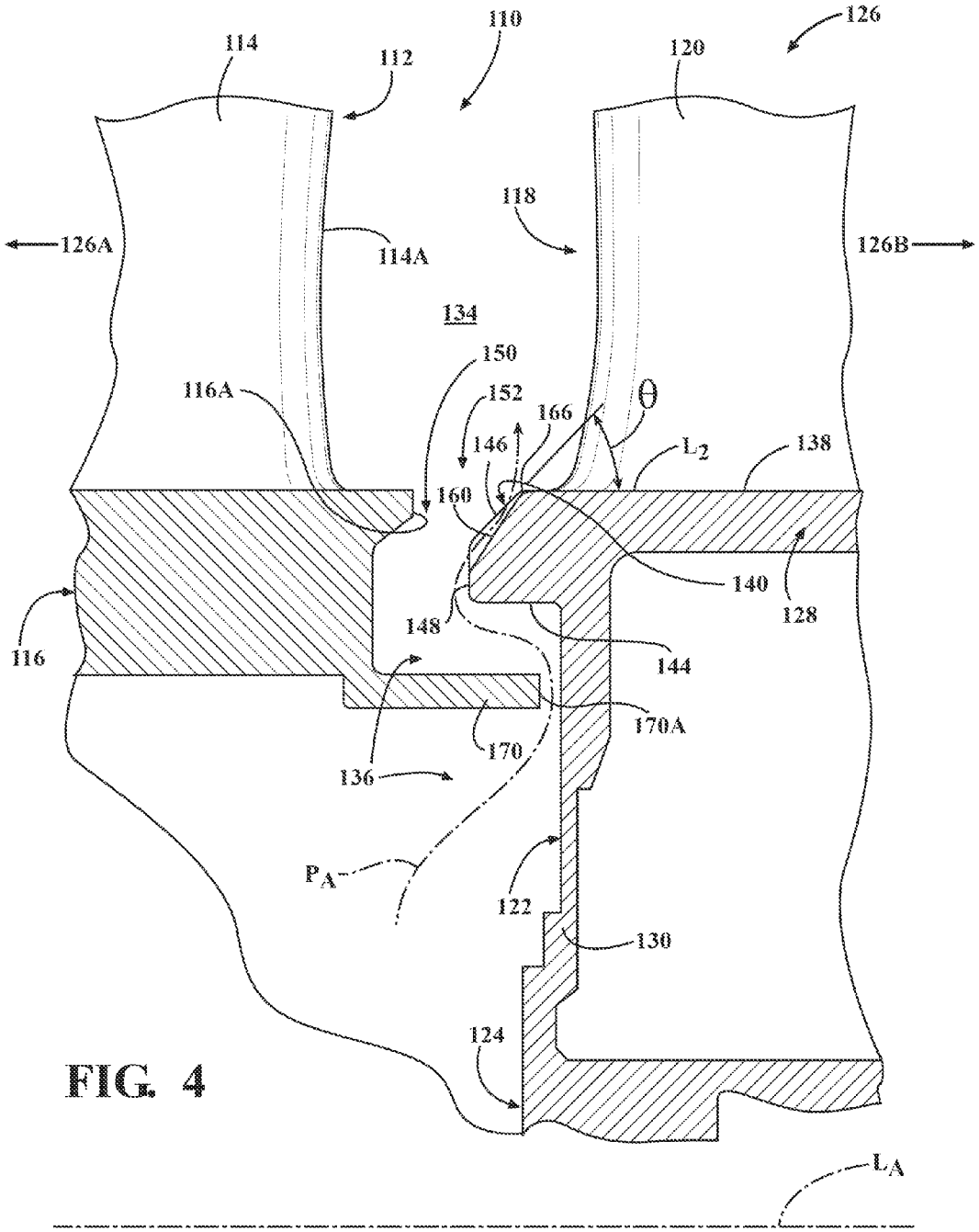
FIG. 4 is a diagrammatic sectional view of a portion of a turbine stage in a gas turbine engine including a seal assembly in accordance with another embodiment of the invention.

Referring to FIG. 4, a portion of a turbine engine 110 is illustrated, where structure similar to that described above with reference to FIGS. 1-3 includes the same reference number increased by 100. The engine 100 is illustrated diagrammatically and includes a stationary vane assembly 112 including a plurality of vanes 114 suspended from an outer casing (not shown) and affixed to an annular inner shroud 116, and a blade assembly 118 downstream from the vane assembly 112 and including a plurality of blades 120 and rotor disc structure 122 that forms a part of a turbine rotor 124. The vane assembly 112 and the blade assembly 118 may be collectively referred to herein as a "stage" of a turbine section 126 of the engine 110, which turbine section 126 may include a plurality of stages as will be apparent to those having ordinary skill in the art. The vane assemblies 112 and blade assemblies 118 are spaced apart from one another in an axial direction defining a longitudinal axis $L_A$ of the engine 110, wherein the vane assembly 112 illustrated in FIG. 4 is upstream from the illustrated blade assembly 118 with respect to an inlet 126A and an outlet 126B of the turbine section 126, see FIGS. 4 and 6.

The rotor disc structure 122 comprises a platform 128, a blade disc 130, and any other structure associated with the blade assembly 118 that rotates with the rotor 124 during operation of the engine 110, such as, for example, roots, side plates, shanks, etc., see FIG. 4.

The vanes 114 and the blades 120 extend into an annular hot gas path 134 defined within the turbine section 126. A working gas $H_G$ (see FIG. 6) comprising hot combustion gases is directed through the hot gas path 134 and flows past the vanes 114 and the blades 120 to remaining stages during operation of the engine 110. Passage of the working gas $H_G$ through the hot gas path 134 causes rotation of the blades 120 and the corresponding blade assembly 118 to provide rotation of the turbine rotor 124.

As shown in FIG. 4, a disc cavity 136 is located radially inwardly from the hot gas path 134 between the annular inner shroud 116 and the rotor disc structure 122. Purge air $P_A$, such as, for example, compressor discharge air, is provided into the disc cavity 136 to cool the inner shroud 116 and the rotor disc structure 122. The purge air $P_A$ also provides a pressure balance against the pressure of the working gas $H_G$ flowing through the hot gas path 134 to counteract a flow of the working gas $H_G$ into the disc cavity 136. The purge air $P_A$ may be provided to the disc cavity 136 from cooling passages (not shown) formed through the rotor 124 and/or from other upstream passages (not shown) as desired. It is noted that additional disc cavities (not shown) are typically provided between remaining inner shrouds 116 and corresponding adjacent rotor disc structures 122.

Figure 5:
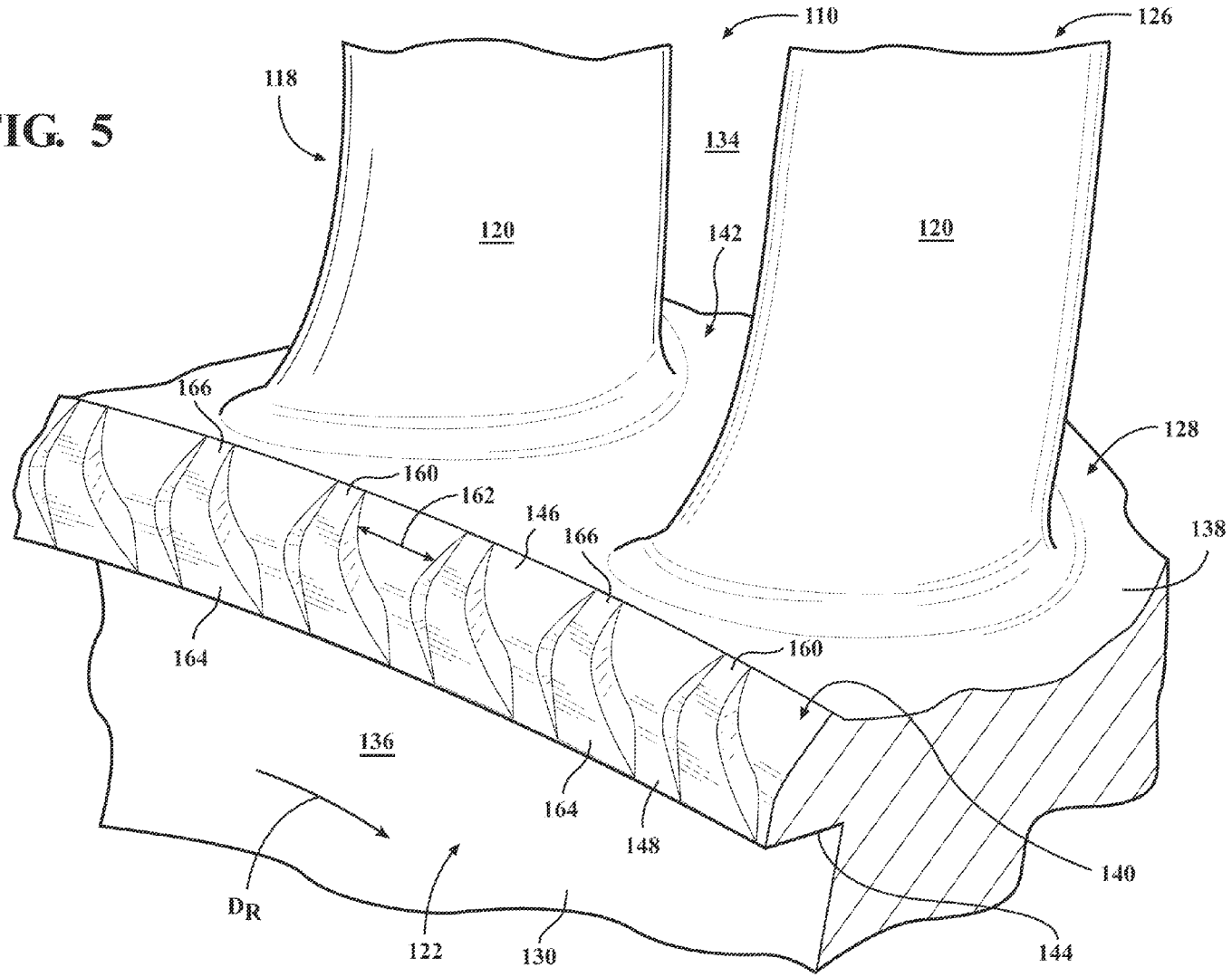
FIG. 5 is a fragmentary perspective view of a plurality of grooves of the seal assembly of FIG. 4.
Figure 6:
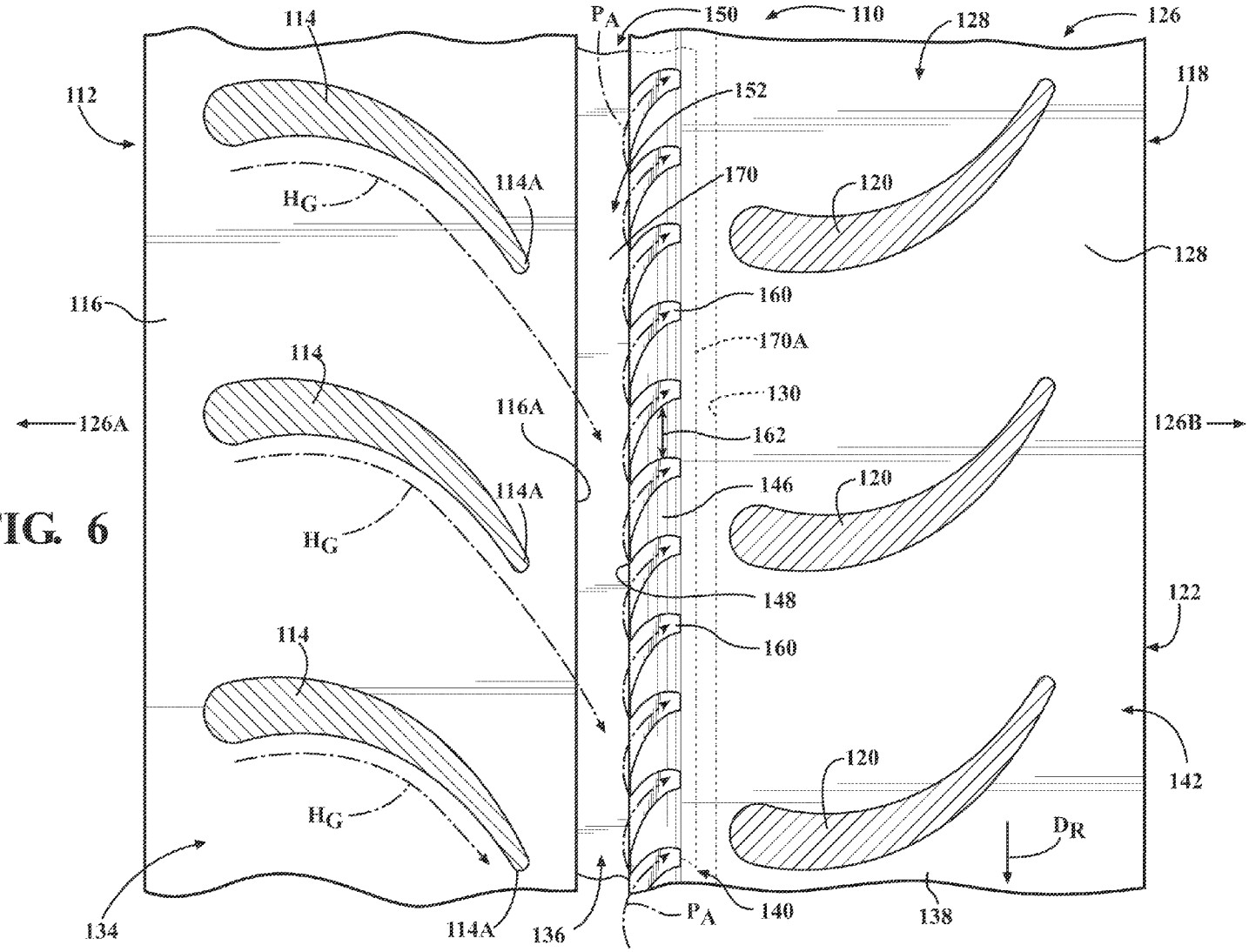
FIG. 6 is a cross sectional view of the stage illustrated in FIG. 4 looking in a radially inward direction.

Referring to FIGS. 4-6, the platform 128 in the embodiment shown comprises a generally radially outwardly facing first surface 138 from which the blades 120 extend. The first surface 138 in the embodiment shown extends from an axially upstream end portion 140 of the platform 128 to an axially downstream end portion 142, see FIGS. 5 and 6.

Figure 5A:
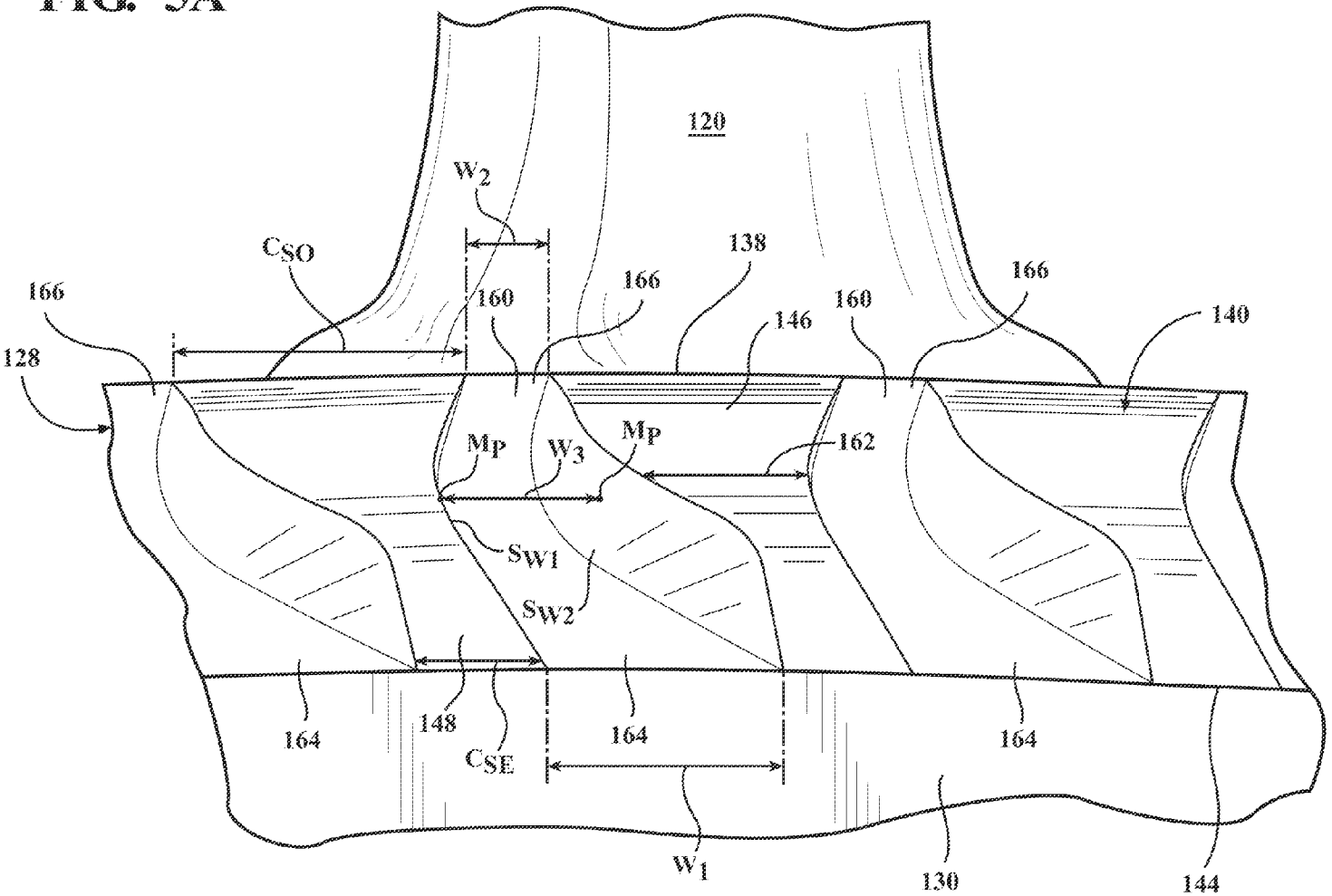
FIG. 5A is an elevational view of a number of the grooves illustrated in FIG. 4.

The platform 128 further comprises a radially inwardly facing second surface 144 that extends from the axially upstream end portion 140 of the platform 128 away from the adjacent vane assembly 112, see FIGS. 4, 5, and 5A.

The axially upstream end portion 140 of the platform 128 comprises a radially outwardly and axially upstream facing third surface 146, and a generally axially facing fourth surface 148 that extends from the third surface 146 to the second surface 144 and faces the inner shroud 116 of the adjacent vane assembly 112. The third surface 146 of the platform 128 in the embodiment shown extends from the first surface 138 at an angle θ relative to a line $L_2$ that is parallel to the longitudinal axis $L_A$, which angle θ is preferably between about 30-60° and is about 45° in the embodiment shown, see FIG. 4.

Components of the platform 128 and the adjacent inner shroud 116 radially inwardly from the respective blades 120 and vanes 114 cooperate to form an annular seal assembly 150 between the hot gas path 134 and the disc cavity 136. The annular seal assembly 150 assists in preventing ingestion of the working gas $H_G$ from the hot gas path 134 into the disc cavity 136 and delivers a portion of the purge air $P_A$ out of the disc cavity 136 in a desired direction with reference to a flow direction of the working gas $H_G$ through the hot gas path 134 as will be described herein. It is noted that additional seal assemblies 150 similar to the one described herein may be provided between the platform 128 and the adjacent inner shroud 116 of the remaining stages in the engine 110, i.e., for assisting in preventing ingestion of the working gas $H_G$ from the hot gas path 134 into the respective disc cavities 136 and to deliver purge air $P_A$ out of the disc cavities 136 in a desired direction with reference to the flow direction of the working gas $H_G$ through the hot gas path 134 as will be described herein.

As shown in FIGS. 4-6, the seal assembly 150 comprises portions of the vane and blade assemblies 112, 118. Specifically, in the embodiment shown, the seal assembly 150 comprises the third and fourth surfaces 146, 148 of the platform 128 and an axially downstream end portion 116A of the inner shroud 116 of the adjacent vane assembly 112. These components cooperate to define an outlet 152 for the purge air $P_A$ out of the disc cavity 136, see FIGS. 4 and 6.

The seal assembly 150 further comprises a plurality of grooves 160, also referred to herein as blade grooves, extending into the third and fourth surfaces 146, 148 of the platform 128. The grooves 160 are arranged such that spaces 162 having components in a circumferential direction defined by a direction of rotation $D_R$ of the turbine rotor 124 and the rotor disc structure 122 are defined between adjacent grooves 160, see FIGS. 5, 5A, and 6. The size of the spaces 162 may vary depending on the particular configuration of the engine 110 and may be selected to fine tune discharging of purge air $P_A$ from the grooves 160, which discharging of the purge air $P_A$ from the grooves 160 will be discussed in more detail below.

As shown most clearly in FIG. 5A, entrances 164 of the grooves 160, i.e., where purge air $P_A$ from the disc cavity 136 to be discharged toward the hot gas path 134 enters the grooves 160, are located in the fourth surface 148 of the platform 128 distal from the first surface 138 of the platform 128. Outlets or exits 166 of the grooves 160, i.e., where the purge air $P_A$ is discharged from the grooves 160, are located proximate to the first surface 138 of the platform 128 in the third surface 146 thereof. The grooves 160 are preferably tapered from the entrances 164 thereof to the exits 166 thereof such that widths $W_1$ of the groove entrances 164 are wider than widths $W_2$ of the groove exits 166, wherein the widths $W_1$, $W_2$ are respectively measured between opposing side walls $S_{W1}$, $S_{W2}$ of the platform 128 that define the grooves 160 with reference to directions substantially perpendicular to the general flow direction of the purge air $P_A$ passing through the respective grooves 160. The tapering of the grooves 160 in this manner is believed to provide a more concentrated and influential discharge of the purge air $P_A$ out of the grooves 160 so as to more effectively prevent ingestion of the working gas $H_G$ into the disc cavity 136 as will be described below.

Further, referring still to FIG. 5A, circumferential spacing $C_{SE}$ between adjacent groove entrances 164 is less than a circumferential width $W_3$ of each groove 160 at sidewall midpoints $M_P$ thereof, and circumferential spacing $C_{SO}$ between adjacent groove outlets 166 is greater than the circumferential width $W_3$ of each groove 160 at the sidewall midpoints $M_P$ thereof. These dimensions of the grooves 160 are believed to provide improved purge air $P_A$ flow performance out of the grooves 160, which will be discussed further below.

Referring to FIG. 5, the grooves 160 are also preferably angled and/or curved in the circumferential direction such that at least a portion of the entrances 164 thereof are located downstream from at least a portion of the exits 166 thereof with reference to the direction of rotation $D_R$ of the turbine rotor 124 and the rotor disc structure 122. Angling and/or curving the grooves 160 in this manner effects a guidance of the purge air $P_A$ from the disc cavity 136 out of the grooves 160 toward the hot gas path 134 such that the purge air $P_A$ flows in a desired direction with reference to the flow of the working gas $H_G$ through the hot gas path 134. Specifically, the grooves 160 according to this aspect of the invention guide the purge air $P_A$ out of the disc cavity 136 such that a flow direction of the purge air $P_A$ is generally aligned with a flow direction of the working gas $H_G$ at a corresponding axial location of the hot gas path 134, which flow direction of the working gas $H_G$ at the corresponding axial location of the hot gas path 134 is generally parallel to exit angles of trailing edges 114A of the vanes 114, see FIG. 6.

As shown in FIGS. 4 and 6, the seal assembly 150 further comprises a generally axially extending seal structure 170 of the inner shroud 116 that extends toward the blade disc 130 of the blade assembly 118. An axial end 170A of the seal structure 170 is preferably in close proximity to the blade disc 130 of the blade assembly 118 such that the seal structure 170 overlaps the upstream end portion 140 of the platform 128. Such a configuration controls/limits the amount of cooling fluid that ultimately flows through the grooves 160 into the hot gas path 134, and also limits the amount of working gas $H_G$ ingestion into the portion of the disc cavity 136 located inwardly of the seal structure 170, i.e., any ingestion of working gas $H_G$ from the hot gas path 134 into the disc cavity 136 must travel through a tortuous path. The seal structure 170 may be formed as an integral part of the inner shroud 116, or may be formed separately from the inner shroud 116 and affixed thereto.

During operation of the engine 110, passage of the hot working gas $H_G$ through the hot gas path 134 causes the blade assembly 118 and the turbine rotor 124 to rotate in the direction of rotation $D_R$ shown in FIGS. 5 and 6.

A pressure differential between the disc cavity 136 and the hot gas path 134, i.e., the pressure in the disc cavity 136 is greater than the pressure in the hot gas path 134, causes purge air $P_A$ located in the disc cavity 136 to flow toward the hot gas path 134, see FIG. 4. As the purge air $P_A$ reaches the fourth surface 148 of the platform 128, a portion of the purge air $P_A$ flows into the entrances 164 of the grooves 160. This portion of the purge air $P_A$ flows radially outwardly through the grooves 160 and then, upon reaching the portions of the grooves 160 within the third surface 146 of the platform 128, the purge air $P_A$ flows radially outwardly and axially within the grooves 160 away from the adjacent upstream vane assembly 112. Due to the angling and/or curving of the grooves 160 as discussed above in combination with the rotation of the grooves 160 along with the turbine rotor 124 and the rotor disc structure 122 in the direction of rotation $D_R$, the purge air $P_A$ is provided with a circumferential velocity component such that the purge air $P_A$ is discharged out of the grooves 160 in generally the same direction as the working gas $H_G$ is flowing after exiting the trailing edges 114A of the upstream vanes 114, see FIG. 6.

The discharge of the purge air $P_A$ from the grooves 160 assists in limiting ingestion of the hot working gas $H_G$ from the hot gas path 134 into the disc cavity 136 by forcing the working gas $H_G$ away from the seal assembly 150. Since the seal assembly 150 limits working gas $H_G$ ingestion from the hot gas path 134 into the disc cavity 136, the seal assembly 150 allows for a smaller amount of purge air $P_A$ to be provided to the disc cavity 136, i.e., since the temperature of the purge air $P_A$ in the disc cavity 136 is not substantially raised by a large amount of working gas $H_G$ passing into the disc cavity 136, thus increasing engine efficiency.

Moreover, since the purge air $P_A$ is discharged out of the grooves 160 in generally the same direction that the working gas $H_G$ flows through the hot gas path 134 after exiting the trailing edges 114A of the upstream vanes 114, there is less pressure loss associated with the purge air $P_A$ mixing with the working gas $H_G$, thus additionally increasing engine efficiency. This is especially realized by the grooves 160 of the present invention since they are formed in the angled third surface 146 of the upstream end portion 140 of the platform 128, such that the purge air $P_A$ discharged from the grooves 160 flows axially in the downstream flow direction of the hot working gas $H_G$ through the hot gas path 134, in addition to the purge air $P_A$ being discharged from the grooves 160 in generally the same circumferential direction as the flow of hot working gas $H_G$ after exiting the trailing edges 114A of the upstream vanes 114, i.e., as a result of the grooves 160 rotating with the turbine rotor 124 and the rotor disc structure 122 and being angled and/or curved in the circumferential direction.

It is noted that the angle and/or curvature of the grooves 160 could be varied to fine tune the discharge direction of the purge air $P_A$ out of the grooves 160. This may be desirable based on the exit angles of trailing edges 114A of the vanes 114 and/or to vary the amount of pressure loss associated with the purge air $P_A$ mixing with the working gas $H_G$ flowing through the hot gas path 134.

It is also noted that the entrances 164 of the grooves 160 could be located further radially inwardly or outwardly in the fourth surface 148 of the platform 128, or the entrances 164 could be located in the third surface 146 of the platform 128, i.e., such that the entireties of the grooves 160 would be located in the third surface 146 of the platform 128.

The grooves 160 described herein are preferably cast with the platform 128 or machined into the platform 128. Hence, a structural integrity and a complexity of manufacture of the grooves 160 are believed to be improved over ribs that are formed separately from and affixed to the platform 128.

Figure 7:
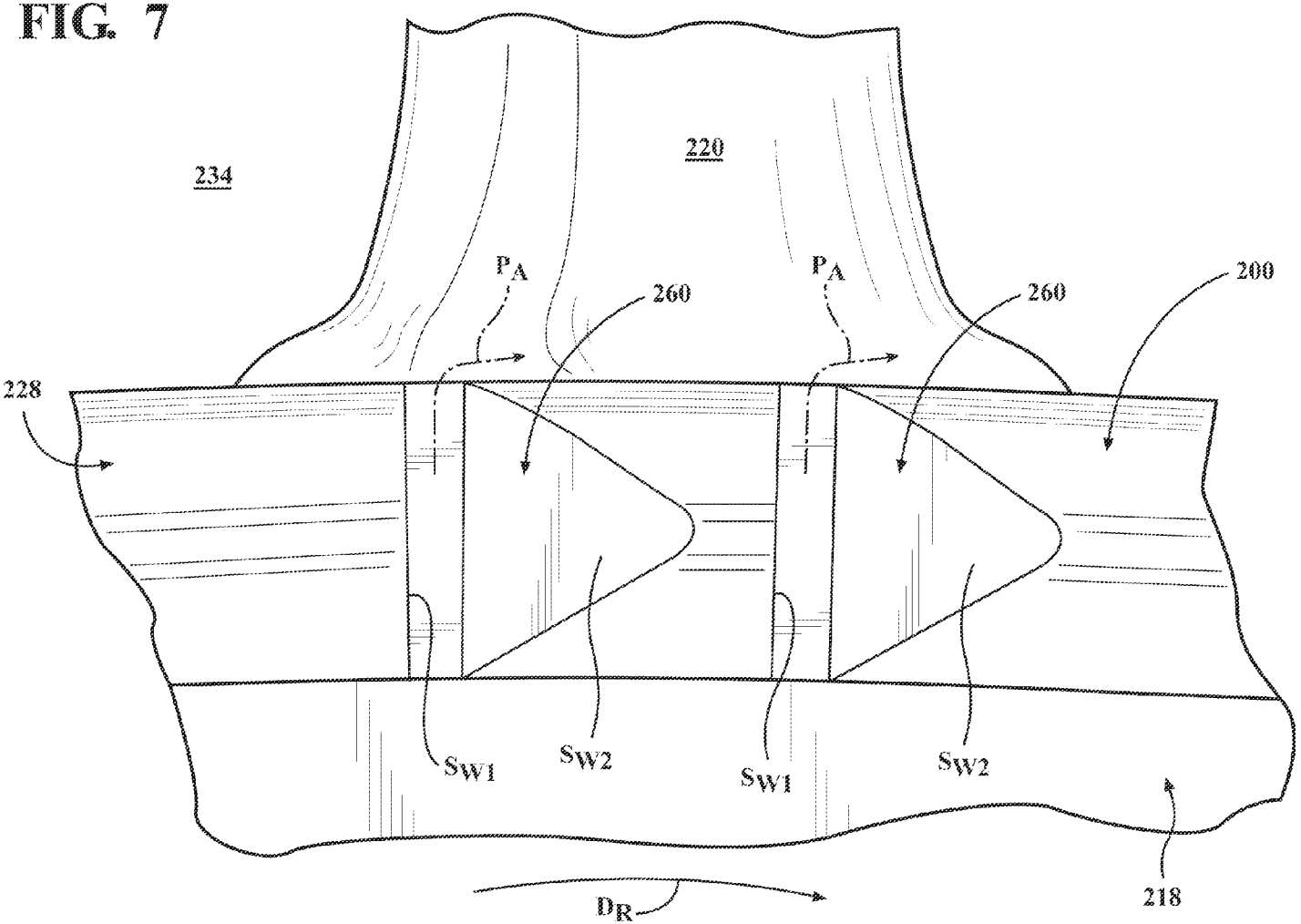
FIG. 7 is a view similar to the view of FIG. 5 and showing a seal assembly in accordance with another embodiment of the invention.

Referring now to FIG. 7, a seal assembly 200 according to a further aspect of the invention is shown, where structure similar to that described above with reference to FIGS. 4-6 includes the same reference number increased by 100. In this embodiment, grooves 260 formed in a blade platform 228 are formed by opposing first and second side walls $S_{W1}$, $S_{W2}$, wherein the first sidewall $SW_1$ comprises a generally radially extending and circumferentially facing wall, and the second sidewall $SW_2$ comprises a generally radially extending wall that faces in the axial and circumferential directions. While the side walls $S_{W1}$, $S_{W2}$ according to this embodiment are generally straight and thus do not themselves provide purge air $P_A$ passing out of the grooves 260 with a circumferential velocity component, since the blade assembly 218 that includes the platform 228 rotates during operation in the direction of rotation $D_R$ as described above with reference to FIGS. 4-6, the purge air $P_A$ passing out of the grooves 260 nonetheless includes a circumferential velocity component, i.e., caused by rotation of the grooves 260 along with the blade assembly 218 in the direction of rotation $D_R$. Hence, the purge air $P_A$ passing out of the grooves 260 according to this aspect of the invention flows in generally the same direction as the hot working gas traveling along the hot gas flow path 234.

Figure 8:
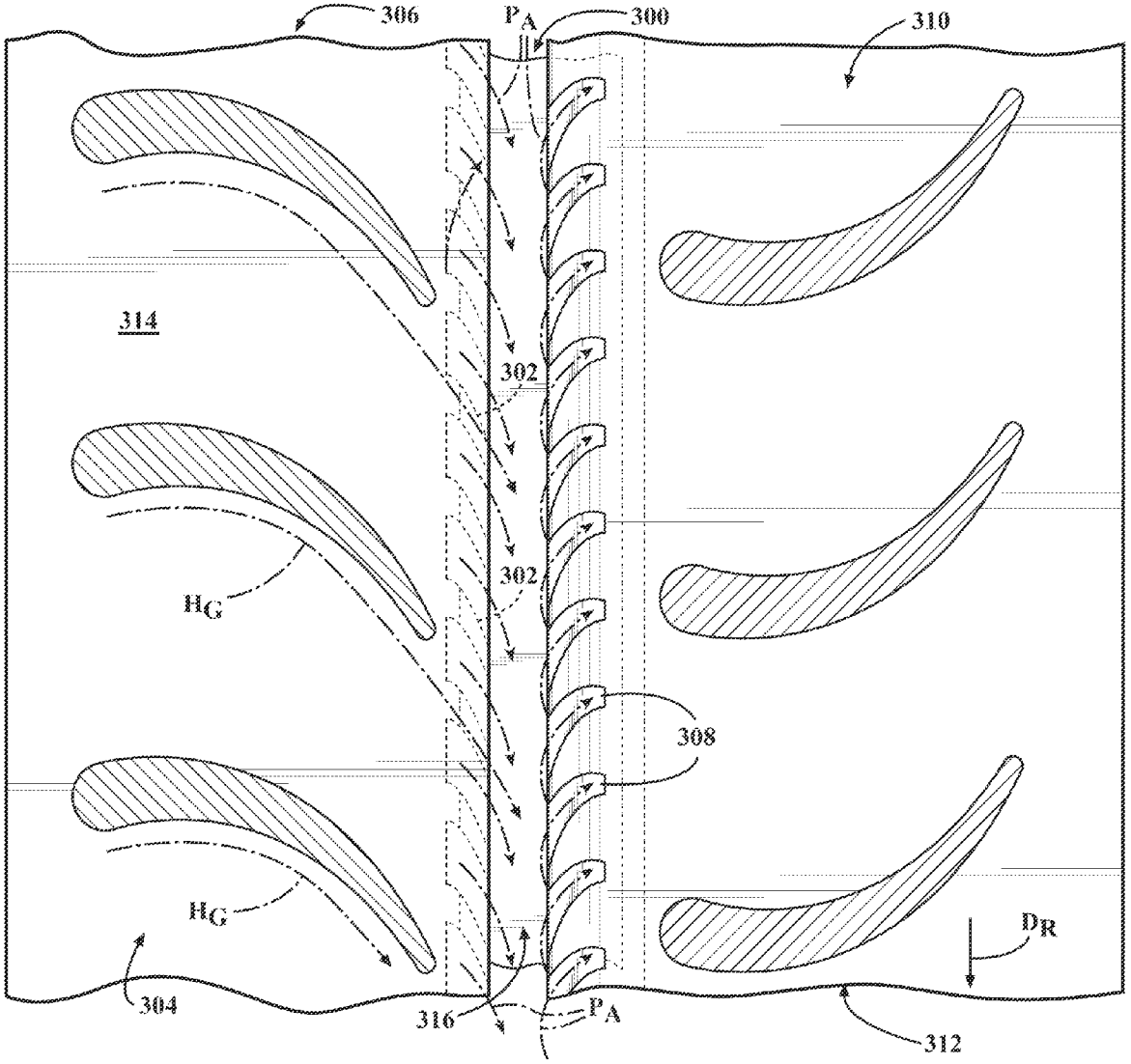
FIG. 8 is a view similar to the view of FIG. 6 and showing a seal assembly in accordance with another embodiment of the invention.

Referring now to FIG. 8, a seal assembly 300 according to a further aspect of the invention is shown. The seal assembly 300 illustrated in FIG. 8 includes first grooves 302 (also referred to herein as vane grooves) located in an inner shroud 304 of a stationary vane assembly 306, and second grooves 308 (also referred to herein as blade grooves) located in a platform 310 of a rotating blade assembly 312. The first grooves 302 may be substantially similar to the grooves 60 described above with reference to FIGS. 1-3, and the second grooves 308 may be substantially similar to the grooves 160 described above with reference to FIGS. 4-6. The seal assembly 300 according to this aspect of the invention may even further limit working gas $H_G$ ingestion from a hot gas path 314 into a disc cavity 316 associated with the seal assembly 300, thus allowing for an even smaller amount of purge air $P_A$ to be provided to the disc cavity 316 and thus further increasing engine efficiency.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly between a disc cavity and a hot gas path that extends through a turbine section of a gas turbine engine comprising:

a stationary vane assembly including a plurality of vanes and an inner shroud;

a rotating blade assembly downstream from the vane assembly and including a plurality of blades that are supported on a platform and rotate with a turbine rotor and the platform during operation of the engine, the platform comprising:

a radially outwardly facing first surface;

a radially inwardly facing second surface;

a third surface facing an axial direction defined by a longitudinal axis of the turbine section; and a plurality of grooves extending into the third surface, the grooves being arranged such that a space having a component in a circumferential direction is defined between adjacent grooves, the circumferential direction corresponding to a direction of rotation of the blade assembly, wherein entrances of the grooves located distal from the first surface of the platform are wider than exits thereof located proximate to the first surface of the platform;

wherein, during operation of the engine, the grooves guide purge air out of the disc cavity toward the hot gas path such that the purge air flows in a desired direction with reference to a direction of hot gas flow through the hot gas path.

2. The seal assembly according to claim 1, wherein the third surface of the platform extends radially inwardly from the first surface of the platform at an angle of about 30° to about 60° relative to the longitudinal axis such that the third surface of the platform also faces in the radial direction.

3. The seal assembly according to claim 1, wherein the grooves are continuously tapered from the entrances thereof to the exits thereof.

4. The seal assembly according to claim 1, wherein circumferential spacing between adjacent groove entrances is less than a circumferential width of the grooves at sidewall midpoints of each corresponding groove and circumferential spacing between adjacent groove exits is greater than the circumferential width of the grooves at the sidewall midpoints of each corresponding groove.

5. The seal assembly according to claim 1, wherein the grooves are at least one of angled and curved in the circumferential direction such that the entrances thereof are located downstream from the exits thereof with reference to the direction of rotation of the blade assembly.

6. The seal assembly according to claim 1, wherein the grooves guide the purge air such that a flow direction of the purge air is generally aligned with the direction of hot gas flow through the hot gas path, which is generally parallel to an exit angle of a trailing edge of at least one of the vanes of the upstream vane assembly.

7. The seal assembly according to claim 1, wherein the platform further comprises a generally axially facing fourth surface that extends radially inwardly from the third surface and faces the adjacent upstream vane assembly, wherein the entrances of the grooves are located in the fourth surface of the platform and the exits of the grooves are located in the third surface of the platform.

8. The seal assembly according to claim 1, wherein the vane assembly further comprises a generally axially extending seal structure that extends from the inner shroud toward the blade assembly and overlaps at least a portion of each of the first, second, and third surfaces of the platform in the axial direction such that purge air flowing from the disc cavity to the hot gas path must follow a tortuous path.

9. The seal assembly according to claim 1, wherein the inner shroud comprises:

a radially outwardly facing first surface;

a radially inwardly facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide additional purge air out of the disc cavity toward the hot gas path such that the additional purge air flows in a desired direction with reference to the direction of hot gas flow through the hot gas path.

10. The seal assembly according to claim 9, wherein the vane grooves are tapered from entrances thereof located distal from an axial end portion of the inner shroud to exits thereof located proximate to the axial end portion of the inner shroud such that the entrances are wider than the exits.

11. The seal assembly according to claim 10, wherein the vane grooves are at least one of angled and curved in the circumferential direction such that the entrances thereof are located upstream from the exits thereof with reference to the direction of rotation of the blade assembly.

12. A seal assembly between a disc cavity and a hot gas path that extends through a turbine section of a gas turbine engine comprising:

a stationary vane assembly including a plurality of vanes and an inner shroud;

a rotating blade assembly downstream from the vane assembly and including a plurality of blades that are supported on a platform and rotate with a turbine rotor and the platform during operation of the engine, the platform comprising:

a radially outwardly facing first surface;

a radially inwardly facing second surface;

a third surface facing an axial direction defined by a longitudinal axis of the turbine section, wherein the third surface of the platform extends radially inwardly from the first surface of the platform at an angle relative to the longitudinal axis such that the third surface of the platform also faces in the radial direction; and a plurality of grooves extending into the third surface, the grooves being arranged such that a space having a component in a circumferential direction is defined between adjacent grooves, the circumferential direction corresponding to a direction of rotation of the blade assembly, wherein the grooves are tapered from entrances thereof located distal from the first surface of the platform to exits thereof located proximate to the first surface of the platform such that the entrances are wider than the exits;

wherein, during operation of the engine, the grooves guide purge air out of the disc cavity toward the hot gas path such that a flow direction of the purge air is generally aligned with the direction of hot gas flow through the hot gas path, which is generally parallel to an exit angle of a trailing edge of at least one of the vanes of the upstream vane assembly.

13. The seal assembly according to claim 12, wherein circumferential spacing between adjacent groove entrances is less than a circumferential width of the grooves at sidewall midpoints of each corresponding groove and circumferential spacing between adjacent groove exits is greater than the circumferential width of the grooves at the sidewall midpoints of each corresponding groove.

14. The seal assembly according to claim 13, wherein the grooves are at least one of angled and curved in the circumferential direction such that entrances thereof located distal from the first surface of the platform are located downstream from exits thereof located proximate to the first surface of the platform with reference to the direction of rotation of the blade assembly.

15. The seal assembly according to claim 12, wherein the vane assembly further comprises a generally axially extending seal structure that extends from the inner shroud toward the blade assembly and overlaps at least a portion of the platform in the axial direction such that purge air flowing from the disc cavity to the hot gas path must follow a tortuous path.

16. The seal assembly according to claim 12, wherein the inner shroud comprises:

a radially outwardly facing first surface;

a radially inwardly facing second surface; and a plurality of vane grooves extending into the second surface of the inner shroud, the vane grooves being arranged such that a space having a component in the circumferential direction is defined between adjacent vane grooves, wherein, during operation of the engine, the vane grooves guide additional purge air out of the disc cavity toward the hot gas path such that the additional purge air flows in a desired direction with reference to the direction of hot gas flow through the hot gas path.

17. The seal assembly according to claim 16, wherein:

the vane grooves are tapered from entrances thereof located distal from an axial end portion of the inner shroud to exits thereof located proximate to the axial end portion of the inner shroud such that the entrances are wider than the exits; and the vane grooves are at least one of angled and curved in the circumferential direction such that the entrances thereof are located upstream from the exits thereof with reference to the direction of rotation of the blade assembly.

18. A seal assembly between a disc cavity and a hot gas path that extends through a turbine section of a gas turbine engine comprising:

a stationary vane assembly including a plurality of vanes and an inner shroud;

a rotating blade assembly downstream from the vane assembly and including a plurality of blades that are supported on a platform and rotate with a turbine rotor and the platform during operation of the engine, the platform comprising:

a radially outwardly facing first surface;

a radially inwardly facing second surface;

a third surface facing an axial direction defined by a longitudinal axis of the turbine section, wherein the third surface of the platform extends radially inwardly from the first surface of the platform at an angle relative to the longitudinal axis such that the third surface of the platform also faces in the radial direction; and a plurality of grooves extending into the third surface, the grooves being arranged such that a space having a component in a circumferential direction is defined between adjacent grooves, the circumferential direction corresponding to a direction of rotation of the blade assembly, wherein circumferential spacing between adjacent groove entrances located distal from the first surface of the platform is less than circumferential spacing between adjacent groove exits located proximate to the first surface of the platform;

wherein, during operation of the engine, the grooves guide purge air out of the disc cavity toward the hot gas path such that a flow direction of the purge air is generally aligned with the direction of hot gas flow through the hot gas path, which is generally parallel to an exit angle of a trailing edge of at least one of the vanes of the upstream vane assembly.

19. The seal assembly according to claim 18, wherein the circumferential spacing between the adjacent groove exits is greater than a circumferential width of the grooves at sidewall midpoints of each corresponding groove.

20. The seal assembly according to claim 18, wherein the vane assembly further comprises a generally axially extending seal structure that extends from the inner shroud toward the blade assembly and overlaps at least a portion of the platform in the axial direction such that purge air flowing from the disc cavity to the hot gas path must follow a tortuous path.

* * * * *